US010626525B2

(12) United States Patent
Cai et al.

(10) Patent No.: US 10,626,525 B2
(45) Date of Patent: Apr. 21, 2020

(54) HOLLOW FABRIC AND MANUFACTURING METHOD THEREOF

(71) Applicant: SUNVIM GROUP CO.,LTD, Gaomi, Shandong Province (CN)

(72) Inventors: Wenyan Cai, Gaomi (CN); Tao Chen, Gaomi (CN); Hongyu Zhao, Gaomi (CN)

(73) Assignee: SUNVIM GROUP CO., LTD., Gaomi (CN)

( * ) Notice: Subject to any disclaimer, the term of this patent is extended or adjusted under 35 U.S.C. 154(b) by 196 days.

(21) Appl. No.: 15/813,125

(22) Filed: Nov. 14, 2017

(65) Prior Publication Data

US 2019/0062960 A1 Feb. 28, 2019

(30) Foreign Application Priority Data

Aug. 30, 2017 (CN) ..... 2017 1 0762434

(51) Int. Cl.

| | |
|---|---|
| ***D03D 13/00*** | (2006.01) |
| ***D03D 1/00*** | (2006.01) |
| ***D03D 15/08*** | (2006.01) |
| ***C11D 3/16*** | (2006.01) |
| ***D06L 4/13*** | (2017.01) |
| ***C11D 3/00*** | (2006.01) |
| ***C11D 11/00*** | (2006.01) |
| ***D02G 3/04*** | (2006.01) |
| ***D06P 1/00*** | (2006.01) |
| ***D06M 11/38*** | (2006.01) |
| ***D06M 15/643*** | (2006.01) |
| ***D06L 4/12*** | (2017.01) |

(52) U.S. Cl.

CPC ..... *D03D 13/00* (2013.01); *C11D 3/001* (2013.01); *C11D 3/162* (2013.01); *C11D 11/0017* (2013.01); *D02G 3/04* (2013.01); *D03D 1/0017* (2013.01); *D03D 15/08* (2013.01); *D06L 4/12* (2017.01); *D06L 4/13* (2017.01); *D06M 11/38* (2013.01); *D06M 15/643* (2013.01); *D06P 1/0004* (2013.01); *D06P 1/0032* (2013.01)

(58) Field of Classification Search

CPC ..... C11D 3/162; C11D 3/001; C11D 11/0017; D06L 4/13; D06L 4/12; D02G 3/04; D06P 1/0004; D06P 1/0032; D06M 11/30; D06M 15/643; D03D 13/00; D03D 1/0017; D03D 15/08

See application file for complete search history.

(56) References Cited

U.S. PATENT DOCUMENTS 3,865,678 A * 2/1975 Okamoto ..... D03D 15/00 428/91

2018/0105962 A1* 4/2018 Yu ..... D02G 3/04

* cited by examiner

*Primary Examiner* — Amina S Khan

(74) *Attorney, Agent, or Firm* — Michael F. Fedrick; Loza & Loza, LLP

(57) ABSTRACT

A hollow fabric is obtained by providing cotton blended yarns and alkali-soluble polyester yarns which are arranged in a ratio of 10:2 as warp yarns, and providing cotton blended elastic yarns and alkali-soluble polyester filaments which are arranged in a ratio of 6:2 as weft yarns. The warp yarns and weft yarns are interwoven into plain weaves, and the plain weaves are subjected to alkali solution to remove the alkali-soluble polyester filaments, thereby obtaining greige cloth having meshes. The greige is subjected to boiled bleaching, softening and drying to obtain the hollow fabric. By optimizing the ratio of yarns and using a boiled bleaching, softening and drying process, a soft, smooth and fluffy product is produced with humidity-absorbing and breathability characteristics.

5 Claims, 3 Drawing Sheets

HOLLOW FABRIC AND MANUFACTURING METHOD THEREOF

CROSS-REFERENCE TO RELATED APPLICATIONS

This application claims the benefit of priority under 35 U.S.C. § 119 from Chinese Patent Application No. 201710762434.9, filed on Aug. 30, 2017. The disclosure of this application is incorporated herein by reference in its entirety.

FIELD OF THE INVENTION

The present invention relates to the field of textile technology, and particularly to a technique on hollow fabric.

BACKGROUND OF THE INVENTION

Beddings are closely related to people's life, most existing beddings are composed of ordinary organizations, the appearances thereof are consistent and old-fashioned. Year-round used beddings only differ in the color and the thickness of the fabric, and there is no change in their structure, this kind of ordinary bedding has poor heat dispersion and breathability. Therefore, there is a need to develop a hollow fabric with a new type of structure according to the needs of the market, which can be used as beddings, regular meshes present on the surface of the cloth, and it has good heat dispersion and breathability, and it is easy to be washed, and is quick-drying, which is especially suitable to be used in summer.

SUMMARY OF THE INVENTION

The present invention discloses a hollow fabric and manufacturing method thereof, wherein the hollow fabric is obtained by the following procedures: cotton blended yarns and alkali-soluble polyester filaments which are arranged according to certain rules are used as warp yarns; cotton blended elastic yarns and alkali-soluble polyester filaments which are arranged according to certain rules are used as weft yarns, the warp yarns and the weft yarns are interwoven into greige cloth, which is subjected to alkali solution to remove the alkali-soluble polyester filaments. 40 Nm cotton blended yarns and 75D twisted alkali-soluble polyester yarns which are arranged in a ratio of 10:2 are used as warp yarns, and 40 Nm cotton blended elastic yarns and the 75D twisted alkali-soluble polyester filaments which are arranged in a ratio of 6:2 are used as weft yarns, the warp yarns and the weft yarns are interwoven into plain weaves; the plain weaves are subjected to alkali solution to remove the alkali-soluble polyester filaments, and obtaining the greige cloth having meshes; the greige cloth having meshes is subjected to the procedures of boiled bleaching, softening and drying, and obtaining the hollow fabric. The present invention optimizes the ratio of yarns, boiled bleaching process, refining agent and softening and drying process, which provides the products with a hand feeling of soft, smooth and fluffy, and the performances of humidity-absorbing and breathability, and improves the use performance and comfort.

The first technical problem solved by the present invention is to provide a hollow fabric in view of the shortcomings of the prior art. The present hollow fabric has regular meshes on the surface of the cloth, it has good heat dispersion and breathability, and it is soft and fluffy, it is quick-drying after be washed, which is easy to be taken care of.

The second technical problem solved by the invention is to provide a method for manufacturing a hollow fabric in view of the shortcomings of the prior art. The present hollow fabric has regular meshes on the surface of the cloth, it has good heat dispersion and breathability, and it is soft and fluffy, it is quick-drying after be washed, which is easy to be taken care of.

In order to solve the first technical problem, the present invention provides the following technical solution:

A hollow fabric which is obtained by following procedures: cotton blended yarns and alkali-soluble polyester filaments which are arranged according to certain rules are used as warp yarns; cotton blended elastic yarns and alkali-soluble polyester filaments which are arranged according to certain rules are used as weft yarns, the warp yarns and the weft yarns are interwoven into greige cloth, which is subjected to alkali solution to remove the alkali-soluble polyester filaments.

In a preferred embodiment, the cotton blended yarns and the alkali-soluble polyester filaments which are arranged in a ratio of 10:2 are used as the warp yarns, and the cotton blended elastic yarns and the alkali-soluble polyester filaments which are arranged in a ratio of 6:2 are used as the weft yarns, the warp yarns and the weft yarns are interwoven into the greige cloth.

In a preferred embodiment, the cotton blended yarns as the warp yarn are 40 Nm cotton blended yarns which are formed by blending cottons and Modal; the cotton blended elastic yarns as the weft yarn are 40 Nm cotton blended elastic yarns which are formed by blending cotton, Modal and Sutans; and the alkali-soluble polyester filaments are 75D twisted alkali-soluble polyester filaments.

In a preferred embodiment, the blending ratio of the cottons and the Modal in the 40 Nm cotton blended yarns is 65:35; the blending ratio of the cottons, Modal and Sutans in the 40 Nm cotton blended elastic yarns is 55:35:10.

In a preferred embodiment, the cotton blended yarns as the warp yarn are the 40 Nm cotton blended yarn which is formed by blending the cottons, polyester colored fiber and Modal colored fiber; the cotton blended elastic yarns as the weft yarn are the 40 Nm cotton blended elastic yarns which are formed by blending the cotton, polyester colored fiber, Modal colored fiber and Sutans; and the alkali-soluble polyester filament is 75D twisted alkali-soluble polyester filament.

In order to solve the second technical problem, the present invention provides the following technical solution:

a method for manufacturing the hollow fabric comprising following steps:

(1) 40 Nm cotton blended yarns and 75D twisted alkali-soluble polyester filaments which are arranged in a ratio of 10:2 are used as the warp yarn, and 40 Nm cotton blended elastic yarns and the 75D twisted alkali-soluble polyester filament which are arranged in a ratio of 6:2 are used as weft yarns, the warp yarns and the weft yarns are interwoven into a plain weave;

(2) the plain weave is stewed with a 25-35 ml/L caustic soda solution containing 36 Baume degree caustic soda at a temperature of 100-110° C. for 40-60 minutes to remove 75D twisted alkali-soluble polyester filament, and obtaining the greige cloth having meshes;

(3) the greige cloth having meshes is boiled bleached, softened and dried to obtain the hollow fabric.

In a preferred embodiment, the cotton and Modal fibers which are blended in a ratio of 65:35 are subjected to opening and cleaning, teasing, drawing, and the roving and spun yarns are blended and spun into 40 Nm cotton blended yarn as the warp yarn; and the cottons, Modal and Sutans are blended and spun in a ratio of 55:35:10 into 40 Nm cotton blended elastic yarns as the weft yarns; the alkali-soluble polyester fibers are subjected to doubling and double-twisting to form 75D twisted alkali-soluble polyester filament.

In a preferred embodiment, the cottons, polyester colored fiber, Modal colored fiber which are blended and spun in a ratio of 50:15:35 are subjected to opening and cleaning, teasing, drawing, and the roving and spun yarns are blended and spun into 40 Nm cotton blended yarn as the warp yarn; and the cottons, polyester colored fiber, Modal colored fiber and Sutans are blended and spun in a ratio of 40:15:35:10 into 40 Nm cotton blended elastic yarns as the weft yarns; the alkali-soluble polyester fibers are subjected to doubling and double-twisting to form the 75D twisted alkali-soluble polyester filament.

As the colored fibers are used for weaving, it is easier to distinguish and control during the sizing process, and the subsequent dyeing process is eliminated.

In a preferred embodiment, the boiled bleaching solution in the boiled bleaching step contains 10-15 ml/L caustic soda solution of 36 Baumé degree caustic soda, 30 wt % of hydrogen peroxide 8-15 ml/L, 1-2 ml/L refining agent of the alkyl polyglycol ether mixture, 4-7 ml/L of multi-functional pretreatment agent, 0.5-3.5 ml/L of organic complexing agent, and the boiled bleaching temperature is 98-101° C., and the boiled bleaching time is 35-45 minutes.

In a further modified embodiment, the refining agent of the alkyl polyglycol ether mixture is FORYL EPD-C (available from Fashion Chemicals GmbH & Co. KG, Geretsried, Germany); the multi-functional pretreatment agent is a multi-functional pretreatment agent STABILOL NC (available from Fashion Chemicals GmbH & Co. KG, Geretsried, Germany); the organic complexing agent is organic complexing agent SECURON CD (available from Fashion Chemicals GmbH & Co. KG, Geretsried, Germany).

In a further modified embodiment, the working solution of the softening agent in the softening and drying steps includes: 25-35 g/L of silicone hydrophilic softening agent, pH is adjusted to 4.5 to 7.5 using a neutralizing acid, the drying temperature is 110-130° C., the vehicle speed is 15-25 m/min.

In a further modified embodiment, the silicone hydrophilic softening agent is a super hydrophilic softener TEXMACROSILK PRIME DA-60; the neutralizing acid is a neutralizing acid AD-1.

The contents of various adjuvants refer to the added amount thereof in the working solution.

In a further modified embodiment, the 75D twisted alkali-soluble polyester filaments are controlled by two separate pieces of healds and a single row of drop wires; which is different from the common straight-draw.

Wherein the refining agent FORYL EPD-C, the multi-functional pretreatment agent STABILOL NC and the organic complexing agent SECURON CD are preferably produced by Kokai Fine Chemicals (Shanghai) Co., Ltd. The softener is preferably TEXMACROSILK PRIME DA-60, which is a super hydrophilic softener produced by Qingdao Onos Industry & Trade Co., Ltd.

As a result of the above technical solution, the advantageous effects of the present invention are as following:

The hollow fabric of the present invention is obtained by following procedures: the cotton blended yarns and the alkali-soluble polyester filaments which are arranged according to certain rules are used as warp yarns; the cotton blended elastic yarns and the alkali-soluble polyester filaments which are arranged according to certain rules are used as weft yarns, the warp yarns and the weft yarns are interwoven into the greige cloth, which is subjected to alkali solution to remove the alkali soluble polyester filaments, and obtaining the hollow fabric. The alkali-soluble polyester filaments are high temperature resistant, can subject to warping sizing, and the chains of the two different materials can be weaved in the same beam, and the alkali-soluble polyester silk can be melted after the alkali treatment, the meshes of regular small grids are present on the cloth cover, it has good heat dispersion and breathability, and it is soft and fluffy, it is quick-drying after be washed, which is easy to be taken care of.

The product of the present application has the good performances of soft and comfortable, excellent moisture absorption and perspiration performance, and the hand feeling thereof is more soft and comfortable than other cotton products, the natural ventilation holes increase the breathability; and the process is simple and reliable, and it is convenient for industrial production.

The cotton blended yarns as the warp yarn of the present invention are 40 Nm cotton blended yarns which are formed by blending cotton and Modal according to a blending ratio of 65:35; the cotton blended elastic yarns as the weft yarn are 40 Nm cotton blended elastic yarns which are formed by blending cotton, Modal and Sutans according to a blending ratio of 55:35:10; the alkali-soluble polyester filaments are 75D twisted alkali-soluble polyester filaments; preferably, the cotton blended yarns and the alkali-soluble polyester filaments which are arranged in a 10:2 ratio are used as the warp yarn, and the cotton blended elastic yarns and the alkali-soluble polyester filaments which are arranged in a ratio of 6:2 are used as the weft yarns; the inventors obtain the above parameters by a large number of experiments; when the above blend ratios of cottons are used, the comfort of the cotton can be maintained, and the soft and smooth, moisture permeability characteristics of the modal are also taken into account, it also has good elastic performance, and it can also improve the spinnability of the yarns.

The preferred boiled bleaching process, refining agent and softening-drying process of the present invention imparts a hand feeling of soft, smooth, fluffy to the product so as to improve serviceability and comfort.

BRIEF DESCRIPTION OF THE DRAWINGS

The invention will now be further described with reference to the accompanying drawings and examples.

DETAILED DESCRIPTION OF THE EMBODIMENTS

Figure 1:
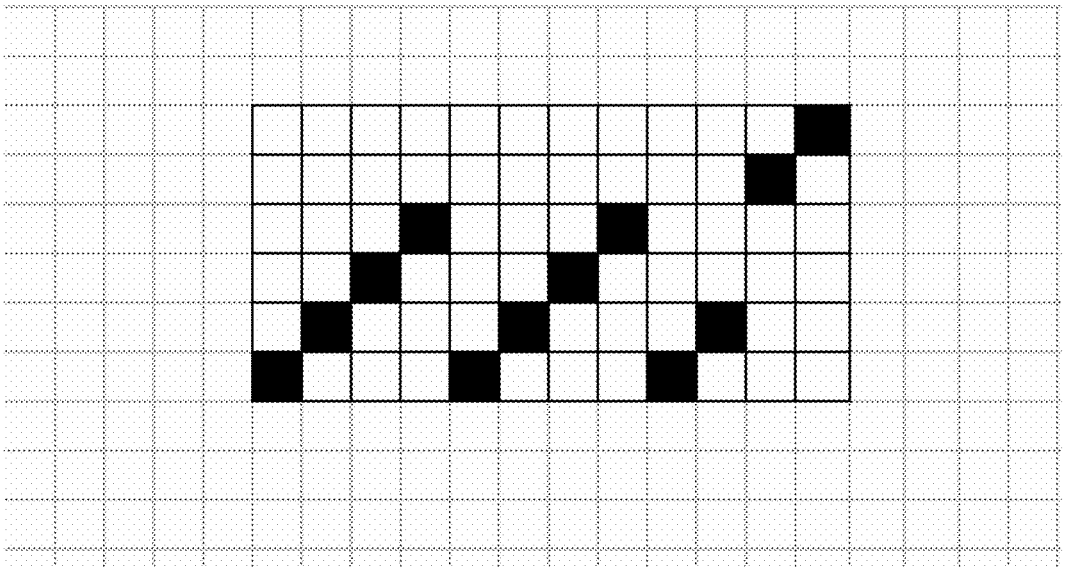
FIG. 1 is a drafting plan of an embodiment of the present invention.

The invention will now be further described with reference to the accompanying drawings and examples. It is to be understood that these examples are merely illustrative of the invention and are not intended to limit the scope of the invention. In addition, it should be understood that various changes and modifications may be made by those skilled in the art upon reading the contents of the present invention, and equivalent form also fall within the scope of the claims appended hereto.

Example 1

A hollow fabric, wherein 40 Nm cotton blended yarns and 75D twisted alkali-soluble polyester filaments which were arranged in a ratio of 10:2 were used as warp yarns, 40 Nm cotton blended yarns were formed by blending cottons and Modal in a blending ratio of 65:35; 40 Nm cotton blended elastic yarns and 75D twisted alkali-soluble polyester filaments which were arranged in a ratio of 6:2 were used as weft yarns, 40 Nm cotton blended elastic yarns were formed by blending cotton, Modal and Sutans according to a blending ratio of 55:35:10, the warp yarns and the weft yarns were interwoven into greige cloth, which was subjected to alkali solution to remove the 5D twisted alkali-soluble polyester filament, and obtaining the hollow fabric.

Example 2

A hollow fabric, wherein 40 Nm cotton blended yarns and 75D twisted alkali-soluble polyester filaments which were arranged in a ratio of 10:2 were used as warp yarns, 40 Nm cotton blended yarns were formed by blending cottons, polyester colored fiber, Modal colored fiber in a blending ratio of 50:15:35; 40 Nm cotton blended elastic yarns and 75D twisted alkali-soluble polyester filaments which were arranged in a ratio of 6:2 were used as weft yarns, 40 Nm cotton blended elastic yarns were formed by blending cottons, polyester colored fiber, Modal colored fiber and Sutans in a blending ratio of 40:15:35:10, the warp yarns and the weft yarns were interwoven into greige cloth, which was subjected to alkali solution to remove the 75D twisted alkali-soluble polyester filaments, and obtaining the hollow fabric.

Example 3

Cottons and Modal were respectively spun into strips, the cotton strips and Modal fiber strips were combined into a cotton blended fabric using a drawing frame, which forms 40 cotton blended cheese through roving, spun yarn, spooling, and 75D alkali-soluble polyester filaments were plying and sizing to improve its weavability. 40 Nm cotton blended yarns and 75D twisted alkali-soluble polyester filaments which were arranged in a ratio of 10:2 were used as warp yarns, 40 Nm cotton blended yarns were formed by blending cottons and Modal in a blending ratio of 65:35; 40 Nm cotton blended elastic yarns and 75D twisted alkali-soluble polyester filaments which were arranged in a ratio of 6:2 were used as weft yarns, 40 Nm cotton blended elastic yarns were formed by blending cottons, Modal and Sutans according to a blending ratio of 55:35:10. The number of meter of 75D twisted alkali-soluble polyester filaments was set according to the contracted quantity, the tube cannot be broken, otherwise during the process of breaking drums, kink can easily happen, and the phenomena that the yarns are ground and scraped also arise.

Warping with Kalman V-type warping machine, the time for open delay of the tensioner on the batch warping machine was set to 8 seconds to ensure there is no twisting phenomenon from the stop state to the normal operation of the warping machine, and there is no tension after the normal driving to ensure the consistent tension of the yarn layer.

When sizing, double-slot single-sided was used to ensure that the tensions on the different yarns in the same layer of yarns is consistent, wherein the 75D twisted alkali-soluble polyester filaments were in the B-slot alone, the cotton blended shaft was in the A-slot. In addition, edible colors were added into the B-slot alone to distinguish 75D twisted alkali-soluble polyester filaments to avoid finding wrong yarns.

Figure 2:
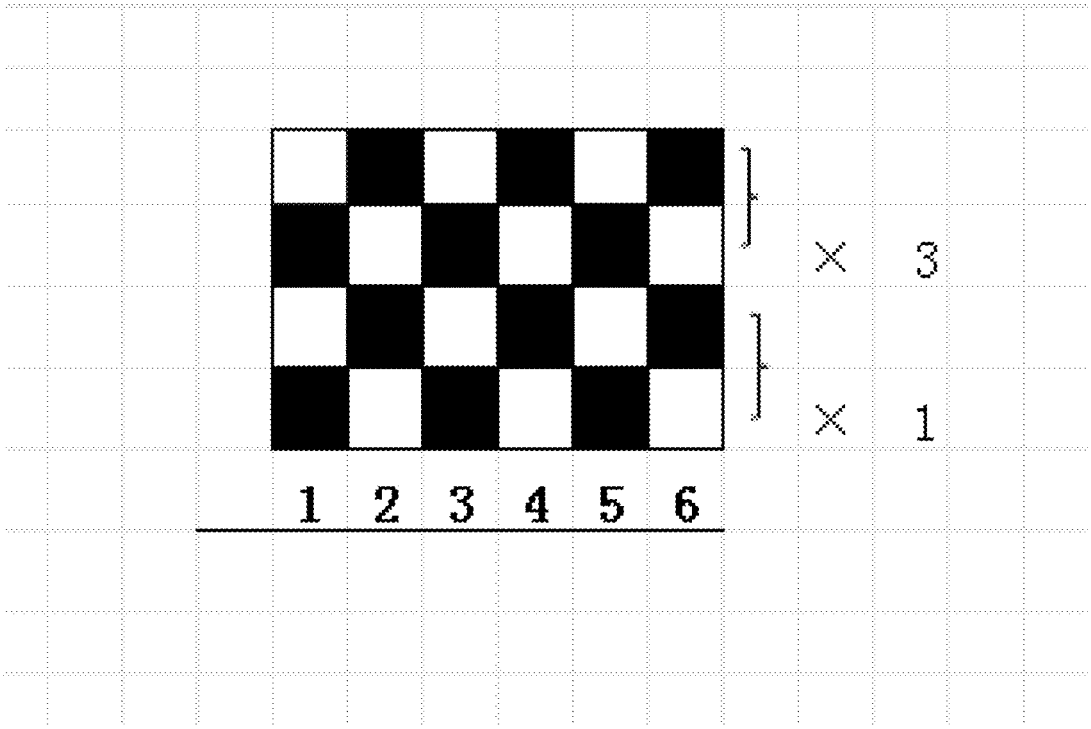
FIG. 2 is a pattern plan of an embodiment of the present invention.
Figure 3:
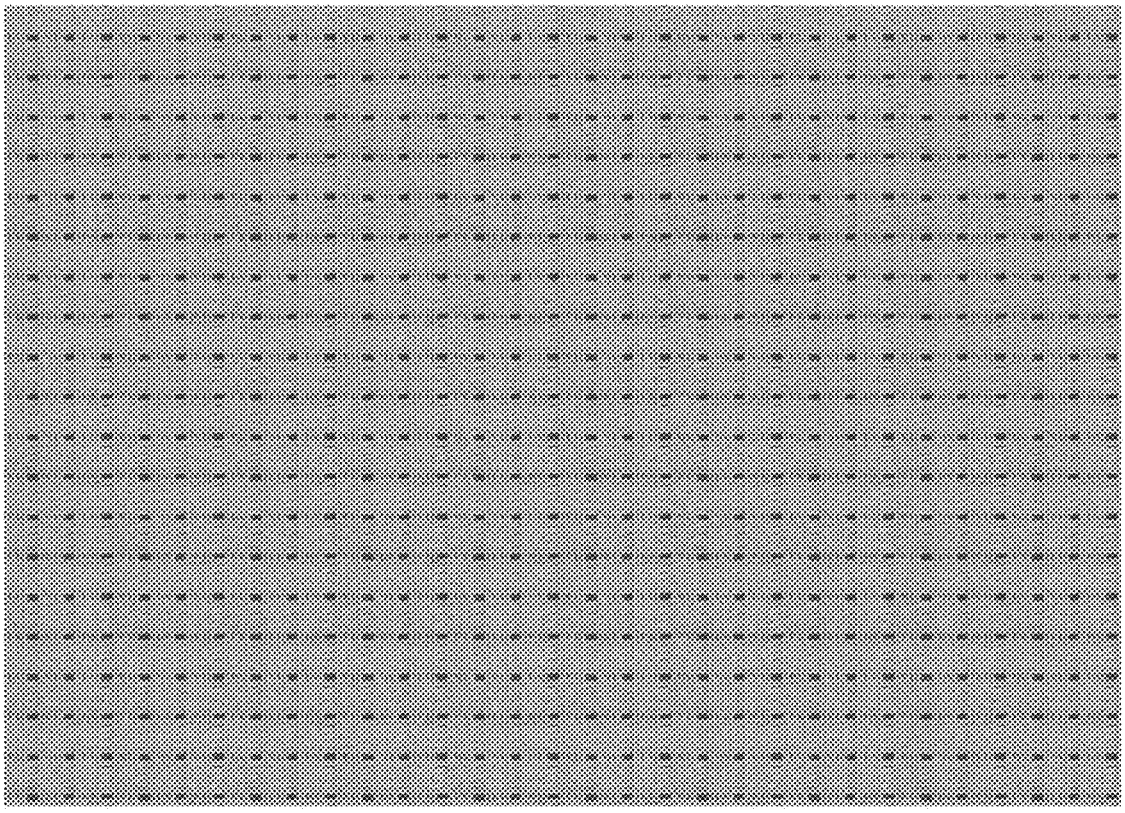
FIG. 3 is a top plan view showing the physical effects of embodiment 1 of the present invention.

The number of palm sheets was 6 when weaving, the 75D twisted alkali-soluble polyester filaments were controlled by two separate pieces of healed frames and a single row of drop wires, so it would not find the wrong yarn after it broke; as the drafting plan of FIG. 1 and pattern plan of FIG. 2 shown, the warp yarns and the weft yarns were interwoven into greige cloth.

The plain weave cloth was sequentially subjected to alkali solution, boiled bleaching, dyeing, softening and drying, and finally sewing into hollow products: the alkali solution contains 36 Baume degree of caustic soda whose added amount was 28 ml/L, the temperature was 108° C., stewing 55 minutes and alkaline dissolving to remove alkali-soluble polyester filaments, and obtaining the greige cloth having meshes; the boiled bleaching solution in the boiled bleaching step contains 12 ml/L solution of 36 Baume degree caustic soda, 30 wt % hydrogen peroxide 10 ml/L, refining agent FORYL EPD-C 1.2 ml/L, multi-functional pretreatment agent STABILOL NC 5 ml/L, organic complexing agent SECURON CD 1.5 ml/L, boiled bleaching temperature was 100° C., boiled bleaching was 45 minutes. Dyeing with huntsman dye RED SE 0.1%, YELLOWSE 0.2%, BLUE SE 0.25%, temperature 102° C., steaming 90 s; the softening agent working solution in the softening and drying step was: super hydrophilic softening agent TEXMACROSILK PRIME DA-60 which was added in an amount of 28 g/L, the pH was adjusted to 5.5 with the neutralization acid, the drying temperature was 120° C., the vehicle speed was 20 m/min.

Wherein, the refining agent FORYL EPD-C, the multi-functional pretreatment agent STABILOL NC and the organic complexing agent SECURON CD were preferably produced by Kokai Fine Chemicals (Shanghai) Co., Ltd. The softener was preferably TEXMACROSILK PRIME DA-60, which is a super hydrophilic softener produced by Qingdao Onos Industry & Trade Co., Ltd.

Example 4

Cottons and Modal color fiber were blended and spun into the raw strips-pre-spinning the pre-drawing strip A, cottons and polyester colored fibers were blended and spun into the raw strip-pre-spinning the pre-strip B, pre-strip A and pre-strip B were blended and spun drawn slivers, which formed 40 cotton blended cheese as warp yarns through roving, spun yarn (siro spinning) and spooling, wherein the cotton, polyester colored fiber, Modal colored fiber were blended in a ratio of 50:15:35; cottons and Modal colored fiber were blended and spun into the raw strips-pre-spinning the pre-drawing strip A, and cottons, Sutans fiber and polyester colored fiber were blended and spun into raw strip-pre-spinning the pre-drawing strip B, pre-drawing strip A and pre-drawing strip B were blended and spun drawn slivers, which formed 40 cotton blended elastic cheese as warp yarns through roving, spun yarn (siro spinning) and spooling, wherein the cottons, polyester colored fiber, Modal colored fiber and Sutans fiber were blended in a ratio of 40:15:35:10, and 75d alkali soluble polyester yarn is plying and sizing to improve its weavability. Cotton blended yarns and 75D twisted alkali-soluble polyester filaments which were arranged in a ratio of 10:2 were used as warp yarns, 40 Nm cotton blended elastic yarns and 75D twisted alkali-soluble polyester filaments which were arranged in a ratio of 6:2 were used as weft yarns. The number of meter of 75D twisted alkali-soluble polyester filaments was set according to the contracted quantity, the tube cannot be broken, otherwise during the process of breaking drums, kink can easily happen, and the phenomena that the yarns are ground and scraped also arise.

Warping with Kalman V-type warping machine, the time for open and stop delay on the batch warping machine was set to 8 seconds, and there was no tension after the normal driving to ensure the consistent tension of the yarn layer.

When sizing, double-slot double-sided was used to ensure that the tension on the different yarns in the same layer of yarn was consistent, wherein the 75D twisted alkali-soluble polyester filaments were in the B-slot alone, the cotton blended shaft is in the A-slot.

The number of palm sheets was 6 when weaving, the 75D twisted alkali-soluble polyester filaments were controlled by two separate piece of healed frames and a single row of drop wires, so it would not find the wrong yarn after it broke; as the drafting plan of FIG. 1 and pattern plan of FIG. 2 shown, the warp yarns and the weft yarns were interwoven into greige cloth.

The plain weave cloth was sequentially subjected to alkali solution, boiled bleaching, softening and drying, and finally sewing into hollow products: the alkali solution contains 36 Baume degree of caustic soda whose adding amount wad 32 ml/L, the temperature was 105° C., cooking 45 minutes and alkaline dissolving to remove alkali-soluble polyester filaments, and obtaining the greige cloth having meshes; the boiled bleaching solution contained in the boiled bleaching step contains 14 ml/L solution of 36 Baume degree caustic soda, 30 wt % hydrogen peroxide 12 ml/L, refining agent FORYL EPD-C 1.5 ml/L, multi-functional pretreatment agent STABILOL NC 6 ml/L, organic complexing agent SECURON CD 2.5 ml/L, boiled bleaching temperature was 99° C., boiled bleaching was 40 minutes. The softening agent working solution in the softening and drying step was: Super hydrophilic softening agent TEXMACROSILK PRIME DA-60 which was added in an amount of 30 g/L, the pH was adjusted to 6.0 with the neutralization acid, the drying temperature was 125° C., the vehicle speed was 22 m/min.

Wherein, the refining agent FORYL EPD-C, the multi-functional pretreatment agent STABILOL NC and the organic complexing agent SECURON CD were preferably produced by Kokai Fine Chemicals (Shanghai) Co., Ltd. The softener was preferably TEXMACROSILK PRIME DA-60, which was a super hydrophilic softener produced by Qingdao Onos Industry & Trade Co., Ltd.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise. Ranges which are described as being "between" two values include the indicated values.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure.

Recitation of value ranges herein is merely intended to serve as a shorthand method for referring individually to each separate value falling within the range. Unless otherwise indicated herein, each individual value is incorporated into the specification as if it were individually recited herein. All references cited herein are incorporated by reference in their entirety.

What is claimed is:

1. A method for manufacturing a hollow fabric, characterized in that the method comprises the following steps:

40 Nm cotton blended yarns and 75D twisted alkali-soluble polyester filaments arranged in a ratio of 10:2 are provided as warp yarns, and 40 Nm cotton blended elastic yarns and the 75D twisted alkali-soluble polyester filaments arranged in a ratio of 6:2 are provided as weft yarns;

weaving the warp yarns and the weft yarns into a plain weave;

stewing the plain weave with a 25-35 ml/L caustic soda solution containing 36 Baume degree caustic soda at a temperature of 100-110° C. for 40-60 minutes to remove the 75D twisted alkali-soluble polyester filament, thereby obtaining a greige cloth having meshes; and boiled bleaching, softening and drying the greige cloth to obtain the hollow fabric.

2. The method according to claim 1, characterized in that cotton and modal fibers which are blended in a ratio of 65:35 are blended and spun into 40 Nm cotton blended yarn as the warp yarns; and the alkali-soluble polyester fibers are subjected to doubling and double-twisting to form the 75D twisted alkali-soluble polyester filaments.

3. The method according to claim 1, characterized in that cottons, polyester colored fiber, modal colored fiber which are blended and spun in a ratio of 50:15:35 into 40 Nm cotton blended yarns as the warp yarns; and the alkali-soluble polyester fibers are subjected to doubling and double-twisting to form the 75D twisted alkali-soluble polyester filament.

4. The method according to claim 1, characterized in that the boiled bleaching step comprises exposure of the greige cloth to a solution containing 10-15 ml/L caustic soda solution of 36 Baume degree caustic soda, 8-15 ml/L hydrogen peroxide, 1-2 ml/L of a refining agent comprising an alkyl polyglycol ether mixture, 4-7 ml/L of a multi-functional pretreatment agent, and 0.5-3.5 ml/L of an organic complexing agent, wherein the boiled bleaching temperature is 98-101° C., and wherein the boiled bleaching time is 35-45 minutes.

5. The method according to claim 1, characterized in that the softening step comprises exposure of the greige cloth to a working solution which includes 25-35 g/L of silicone hydrophilic softening agent having a pH which is adjusted to between 4.5 and 7.5 using a neutralizing acid, and the drying step comprises exposure to a drying temperature of 110-130° C.

* * * * *